US006598630B1

(12) United States Patent
Trippi, Jr.

(10) Patent No.: US 6,598,630 B1
(45) Date of Patent: Jul. 29, 2003

(54) MULTI-FLOW POUR SPOUT

(75) Inventor: John Trippi, Jr., Morton Grove, IL (US)

(73) Assignee: Midwest Can Company, Melrose Park, IL (US)

( * ) Notice: Subject to any disclaimer, the term of this patent is extended or adjusted under 35 U.S.C. 154(b) by 0 days.

(21) Appl. No.: 10/075,781

(22) Filed: Feb. 14, 2002

(51) Int. Cl.[7] ..... B65B 1/04

(52) U.S. Cl. ..... 141/350; 141/352; 141/302

(58) Field of Search ..... 141/2, 4, 7, 59, 141/67, 94, 192, 198, 285, 286, 290, 291, 301, 302, 351–354; 222/566–571, 484, 514, 518, 525

(56) References Cited

U.S. PATENT DOCUMENTS

| | | | | |
|---|---|---|---|---|
| 525,744 | A | | 9/1894 | Roth |
| 530,228 | A | | 12/1894 | Keiner |
| 539,422 | A | | 5/1895 | Ebert |
| 1,470,235 | A | | 10/1923 | House, Jr. |
| 1,561,200 | A | | 11/1925 | Wiseman |
| 1,731,585 | A | | 10/1929 | McGhee et al. |
| 1,736,598 | A | | 11/1929 | Hyatt |
| 1,745,011 | A | | 1/1930 | Fréjacques |
| 2,197,368 | A | | 4/1940 | Minard |
| 2,325,419 | A | | 7/1943 | Minard |
| 2,326,251 | A | | 8/1943 | Piquerez |
| 2,620,110 | A | | 12/1952 | Spencer |
| 2,723,793 | A | | 11/1955 | Hubbell |
| 3,207,190 | A | * | 9/1965 | Silbereis ..... 141/198 |
| 3,540,402 | A | * | 11/1970 | Kocher ..... 141/198 |
| 3,845,791 | A | | 11/1974 | Friendship |
| 4,232,715 | A | | 11/1980 | Pyle |
| 4,513,797 | A | | 4/1985 | Tompkins, Jr. |
| 4,556,093 | A | | 12/1985 | Jones |
| 4,598,743 | A | | 7/1986 | Milling |
| 4,651,889 | A | | 3/1987 | Uranishi et al. |
| 4,667,710 | A | | 5/1987 | Wu |
| 4,667,711 | A | | 5/1987 | Draft |
| 4,834,151 | A | | 5/1989 | Law |
| 4,984,612 | A | | 1/1991 | de la Haye |
| 5,069,260 | A | | 12/1991 | Shea |
| 5,076,333 | A | | 12/1991 | Law |
| 5,095,937 | A | | 3/1992 | LeBlanc et al. |
| 5,228,487 | A | | 7/1993 | Thiermann et al. |
| 5,234,038 | A | | 8/1993 | Mitchell et al. |
| 5,241,983 | A | | 9/1993 | Lagache |
| 5,249,611 | A | | 10/1993 | Law |
| 5,406,994 | A | | 4/1995 | Mitchell et al. |
| 5,419,378 | A | | 5/1995 | Law |
| 5,704,408 | A | | 1/1998 | Law |
| 5,762,117 | A | | 6/1998 | Law |
| 6,397,902 | B1 | * | 6/2002 | Murphy ..... 141/59 |
| 6,478,058 | B1 | * | 11/2002 | Pears ..... 141/353 |

OTHER PUBLICATIONS

*"Portable Fuel Container Spillage Control Regulations—Final Statement of Reasons," State of California Environmental Protection Agency Air Resources Board*, Jun. 2000, 47 pages.

(List continued on next page.)

*Primary Examiner*—Steven O. Douglas
(74) *Attorney, Agent, or Firm*—Wallenstein & Wagner, Ltd.

(57) ABSTRACT

A spill-proof pour spout for transferring fluid from a container to a vessel comprising a base having an inner sleeve extending outwardly therefrom, a conduit member located in the inner sleeve, and an outer sleeve slidingly engaging the inner sleeve. The conduit member has a fluid tube, and air tube and an end cap. The outer sleeve is in a first closed position wherein the outer sleeve contacts the end cap preventing fluid flow from the pour spout. The pour spout can only be opened by rotating the outer sleeve to a first or second indexing position. By rotating the outer sleeve either clockwise or counterclockwise relative to the inner sleeve, the outer sleeve is adapted to be slid to a first open position permitting fluid to flow at a first flow rate through the fluid tube and out of the pour spout. By further rotating the outer sleeve either clockwise or counterclockwise, the outer sleeve is adapted to be slid to a second open position permitting fluid to flow at a second flow rate through the fluid tube at a second flow rate and out of the pour spout.

28 Claims, 7 Drawing Sheets

OTHER PUBLICATIONS

"*Regulations—Portable Fuel Containers and Spouts,*" *State of California Environmental Protection Agency Air Resources Board*, Adopted: Jul. 6, 2000, 15 pages.

"*Spill–Proof System and Spill–Proof Spout Test Procedure—Test Method 510—Automatic Shut–Off Test Procedure For Spill–Proof Systems and Spill–Proof Spouts,*" *State of California Environmental Protection Agency Air Resources Board*, Adopted: Jul. 6, 2000 (section numbers corrected Sep. 13, 2000), 6 pages.

"*Spill–Proof System and Spill–Proof Spout Test Procedure—Test Method 511—Automatic Closure Test Procedure For Spill–Proof Systems and Spill–Proof Spouts,*" *State of California Environmental Protection Agency Air Resources Board*, Adopted: Jul. 6, 2000 (section numbers corrected Sep. 13, 2000), 8 pages.

"*Spill–Proof System and Spill–Proof Spout Test Procedure—Test Method 512—Determination of Fuel Flow Rate For Spill–Proof Systems and Spill–Proof Spouts,*" *State of California Environmental Protection Agency Air Resources Board*, Adopted: Jul. 6, 2000 (section numbers corrected Sep. 13, 2000), 5 pages.

"*Spill–Proof System and Spill–Proof Spout Test Procedure—Test Method 513—Determination of Permeation Rate For Spill–Proof Systems,*" *State of California Environmetnal Protection Agency Air Resources Board*, Adopted: Jul. 6, 2000 (section numbers corrected Sep. 13, 2000), 8 pages.

* cited by examiner

HIGH FLOW POSITION

LOW FLOW POSITION

CLOSED POSITION

MULTI-FLOW POUR SPOUT

CROSS-REFERENCE TO RELATED APPLICATIONS

Not Applicable.

FEDERALLY SPONSORED RESEARCH OR DEVELOPMENT

Not Applicable.

BACKGROUND OF THE INVENTION

This invention relates to pour spouts for containers of fluid, and more particularly to pour spouts which permit transfers of fluid (liquid) based on the influence of gravity at multiple flow rates, and without the risk of spills or overflow.

It is desirable to avoid overfilling of fuel to internal combustion engines in lawnmowers, tractors, personal water craft, chain saws and power tools, outboard motors, ATV recreational vehicles and even automobiles. Spilled fuel presents health and safety risks to people and the environment in general. As a result, many states have now passed environmental legislation which regulates pour spouts which can be used in conjunction with volatile fuels and other liquids.

The opportunity for spills have various causes. First, often times the gas tanks in the aforementioned internal combustion engines have very narrow openings which requires precise pouring and/or a facilitating pour spout or funnel to prevent spills.

Many times spills occur because the operator of the pour spout does not know when the receiving vessel is full. In these cases, overflows occur before pouring can be terminated.

Yet another cause of spills is the ineffective venting of the container from which the fluid is being transferred. The result of ineffective venting is an uneven fluid flow, and even in some cases surging of the fluid. Surges can cause splashing and an uneven flow makes it extremely difficult to predict fluid levels in the receiving vessel.

Another problem encountered by gravity influenced pour spouts is airlock caused by improper venting. Airlock occurs as a result of improper venting in combination with specific volume and viscosity parameters of the fluid being transferred. Such a condition can result in fluid which will not pour even when the container is inverted. This problem, while annoying, can normally be resolved by turning the container right side up again. However, this only increases the opportunity for spills.

Examples of prior spill-proof pour spouts include U.S. Pat. Nos. 4,598,743, 4,834,151, 5,076,333, 5,249,611, 5,419,378, 5,704,408, and 5,762,117. These pour spouts all have the following drawbacks; they do not provide multiple flow rate options and they do not provide childproof locks. The present invention solves these and other problems.

SUMMARY OF THE INVENTION

One object of the present invention is to provide a pour spout for a container of fluid which will preclude the overflow of any receiving vessel into which the fluid is transferred.

Another object of the present invention is to provide a pour spout for a container which will eliminate spills when transferring fluid from the container to a receiving vessel.

Another object of the present invention is to provide a spill-proof pour spout that allows fluid to be transferred from a container to a receiving vessel at various flow rates.

Finally, it is an object of the present invention to provide a spill-proof pour spout with a childproof safety lock which prevents children from accidently spilling, pouring or dumping fluid from a container.

To achieve the foregoing objectives, the present invention provides, in a first embodiment, a pour spout for transferring fluid from a container to a vessel. The pour spout comprises a base having an inner sleeve extending outwardly therefrom, a conduit member located in the inner sleeve, and an outer sleeve slidingly engaging the inner sleeve. The conduit member has a fluid tube, an air tube and an end cap. The outer sleeve is in a first closed position wherein the outer sleeve contacts the end cap preventing fluid flow from the pour spout. The pour spout can only be opened by rotating the outer sleeve to a first or second indexed position. By rotating the outer sleeve relative to the inner sleeve, the outer sleeve is adapted to be slid to a first open position permitting fluid to flow at a first flow rate through the fluid tube and out of the pour spout. By further rotating the outer sleeve, the outer sleeve is adapted to be slid to a second open position permitting fluid to flow at a second flow rate through the fluid tube at a second flow rate and out of the pour spout.

In a second embodiment, there is provided a pour spout for transferring fluid from a container to a vessel. The pour spout comprises a base having an inner sleeve extending outwardly therefrom, a conduit member located in the inner sleeve and an outer sleeve slidingly engaging the inner sleeve. The conduit member has a fluid tube, a first air tube, a second air tube and an end cap. A biasing member urges the outer sleeve into an initial closed position that precludes the transfer of fluid through the pour spout. The base has a protrusion which coacts with the outer sleeve and a plurality of slots in the outer sleeve to facilitate an initial closed position, a first open position and a second open position. The outer sleeve also has a shoulder for coacting with the vessel to slide the outer sleeve relative to the inner sleeve from the closed position to either a first or a second open position.

These and other aspects and attributes of the present invention will be discussed with reference to the following drawings and accompanying specification.

DETAILED DESCRIPTION OF THE INVENTION

Figure 1:
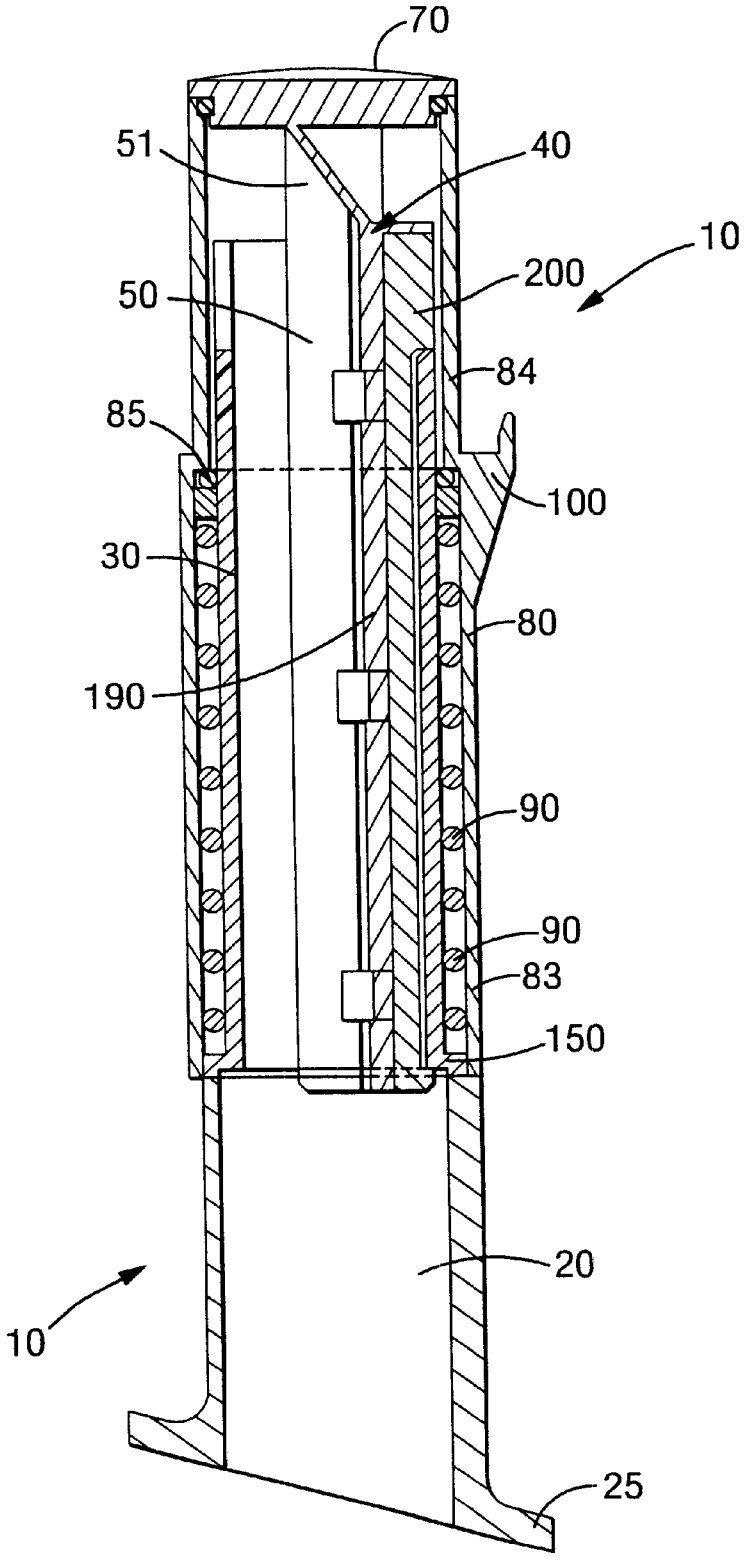
FIG. 1 is a cross-sectional view of a pour spout according to one embodiment of the present invention.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 2C:
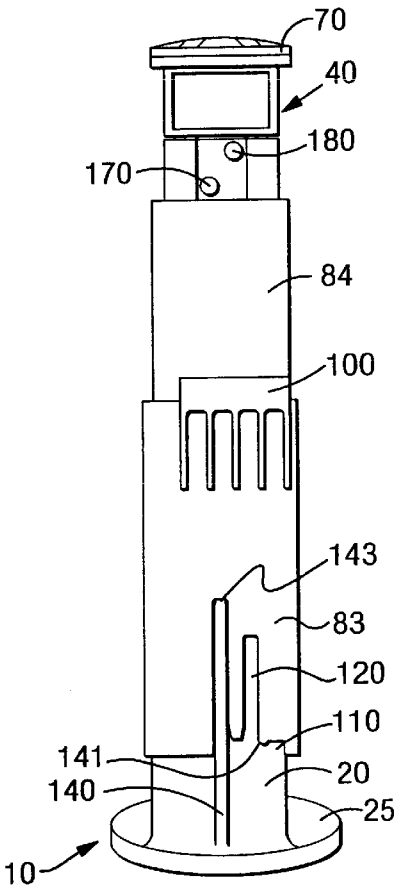
FIG. 2C is a first elevational view of the pour spout shown in FIGS. 2A and 2B in a second open position.
Figure 2B:
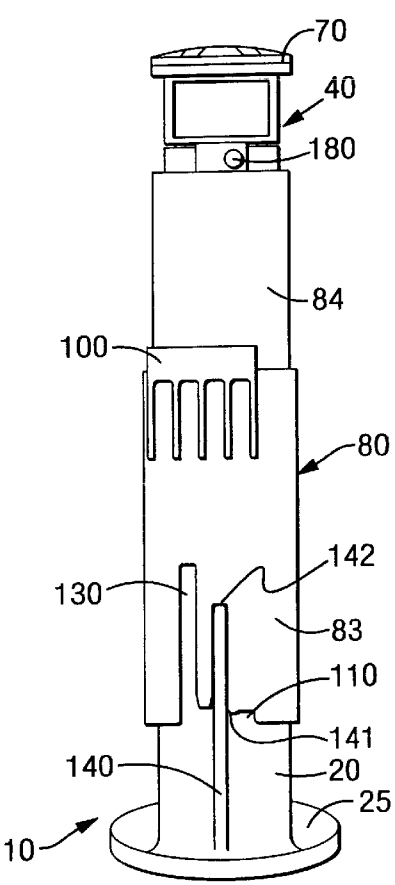
FIG. 2B is a first elevational view of the pour spout shown in FIG. 2A in a first open position.
Figure 2A:
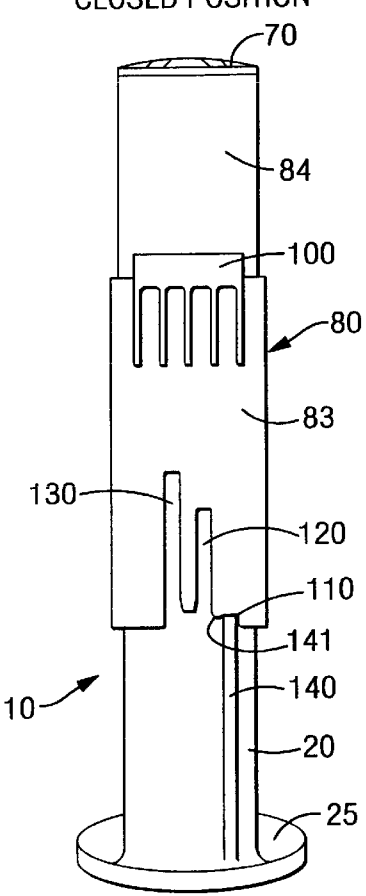
FIG. 2A is a first elevational view of a pour spout according to one embodiment of the present invention in a closed position.

Referring to FIGS. 1–13 there is shown a spill-proof pour spout 10 according to a preferred embodiment of the present invention. As shown in FIG. 1, the spill-proof pour spout 10 includes a base 20 having an inner sleeve 30 extending outwardly therefrom. A conduit member 40 is located in the inner sleeve 30 and includes a fluid tube 50, a first and a second air tube 60, 61 (see FIG. 9) and an end cap 70. An outer sleeve 80 engages the inner sleeve 30 and is held in a normally closed position by a biasing member 90, such as a spring or elastomeric member. In the normally closed position, the outer sleeve 80 is biased against the end cap 70 by the biasing member 90, thereby preventing flow through the fluid tube 50. The outer sleeve 80 is rotatably and slidably moveable with respect to the inner sleeve 30 to facilitate multiple positions of the pour spout 10. In a preferred embodiment, the pour spout 10 is positionable in three indexed positions, a locked position as shown in FIG. 2A, a low flow position as shown in FIG. 2B, and a high flow position as shown in FIG. 2C. It is to be understood, however, that the pour spout 10 can be provided with numerous other positions, including additional positions for additional flow rates.

When describing the functionality of the spill-proof pour spout 10 of the present invention, it will be presumed that the pour spout 10 is attached to a fluid-filled container, such as, for example, a gasoline container, and a user of the pour spout is attempting to transfer fluid from the container to a receiving vessel having a receptacle into which the spout can be inserted.

Figure 3B:
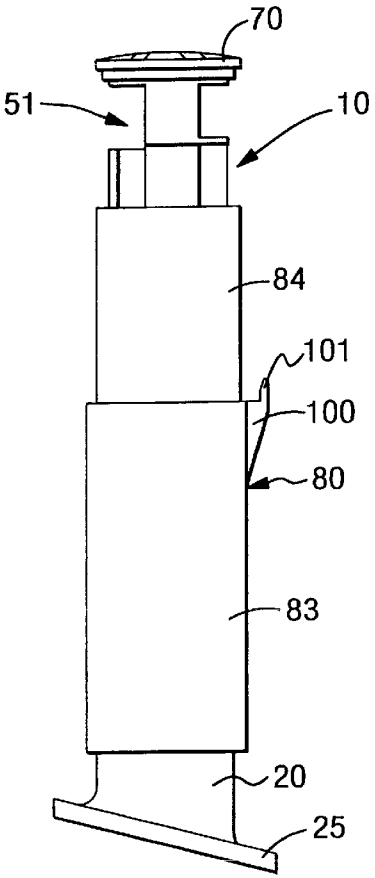
FIG. 3B is a second elevational view of the pour spout shown in the second open position of FIG. 2C.
Figure 3A:
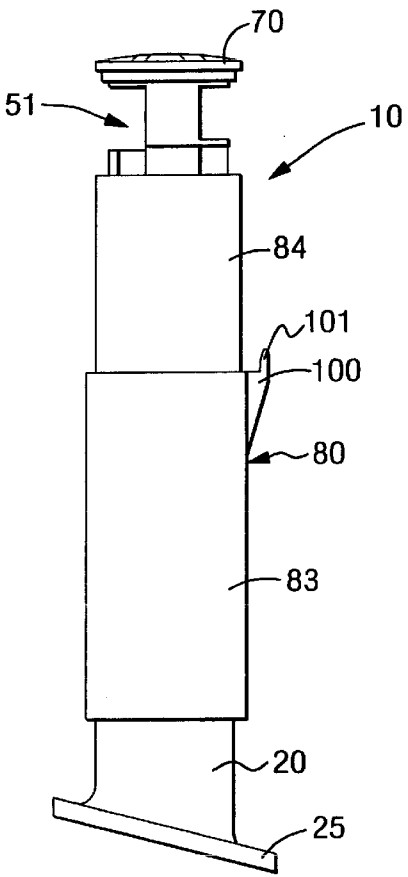
FIG. 3A is a second elevational view of the pour spout shown in the first open position of FIG. 2B.

As shown in FIGS. 2A–2C, the outer sleeve 80 also includes a first slot 110, a second slot 120 and a third slot 130. The base 20 includes a protrusion 140 that cooperates with the slots 110,120,130 in the outer sleeve 80 to facilitate indexable positioning of the pour spout 10. The outer sleeve 80 is rotatable with respect to the inner sleeve 30 so that the protrusion 140 can be aligned with one of the slots 110,120, 130. The first slot 110 facilitates a locked position. The outer sleeve 80 includes a detent 141 that maintains the protrusion 140 within the slot 110 in a locked position. The pour spout 10 can be unlocked when a sufficient force is applied to the outer sleeve 80 with respect to the inner sleeve 30 to allow the protrusion 140 to slide past the detent 141. Once unlocked, the outer sleeve 80 can be rotated with respect to the inner sleeve 30 to allow alignment of the protrusion 140 with one of the slots 120,130, which, in turn, allows the inner sleeve to be slid into an open position. As shown in FIGS. 3A and 3B, the outer sleeve 80 of the pour spout 10 includes a shoulder 100 having a lip 101. The shoulder 100 of the outer sleeve 80 coacts with the receptacle of the receiving vessel to permit the outer sleeve 80 to slide relative to the inner sleeve 30 into an open position when pressure is applied to the spout 10 by the user. As shown in FIGS. 2B and 3A, a low flow open position is achieved when the outer sleeve 80 is slid such that the protrusion 140 is held against an end surface 142 of the slot 120. In similar fashion, as shown in FIGS. 2C and 3B, a high flow position is achieved when the outer sleeve 80 is slid such that the protrusion 140 is held against an end surface 143 of the slot 130.

It should be noted that in the locked position, the outer sleeve 80 is maintained in the normally biased closed position against the end cap 70. In order to allow the protrusion 140 to rotate past the detent 141, a plastic material may be utilized that allows some flexion of the detent and/or protrusion. Additionally, an elastomeric compression-type seal may be utilized below the end cap 70 that will allow the outer sleeve 80 to be slidably pushed against the end cap just enough to further compress the seal and allow the protrusion to rotate past the detent 141.

Figure 4:
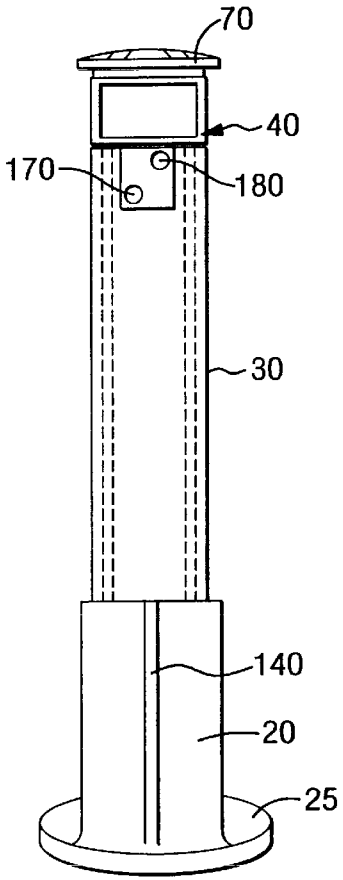
FIG. 4 is an elevational view of the pour spout shown in FIGS. 2A–2C without the outer sleeve and bias member.
Figure 5:
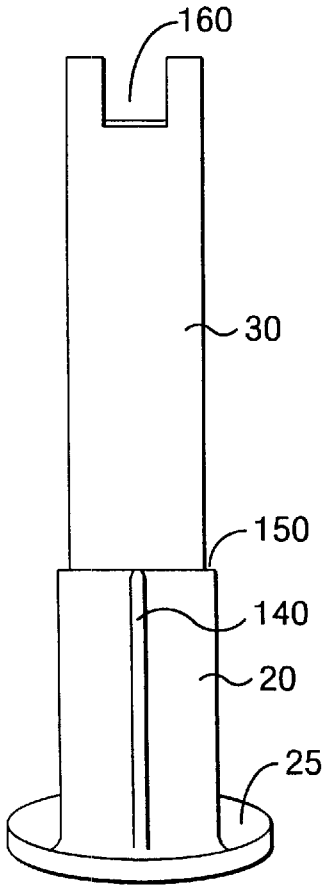
FIG. 5 is an elevational view of the base of the pour spout shown in FIGS. 1–4.

Referring now to FIGS. 4 and 5, in the preferred embodiment illustrated, the base has a larger diameter than the inner sleeve 30 which extends outwardly from one end of the base 20. This creates a step 150 that extends radially around one end of the base 20. As shown in FIG. 1, the biasing member 90 in the preferred embodiment is a spring that is disposed around the inner sleeve 30, with one end of the spring 90 resting on the step 150. Referring once again to FIG. 5, at the end of the inner sleeve 30 opposite the base 20, there is a notched portion 160 which receives the conduit member 40 as will be explained further below. The other end of the base 20 has a connector flange 25 that cooperates with a threaded collar of a container (not shown) to facilitate connection of the pour spout 10 to the container.

Figure 6:
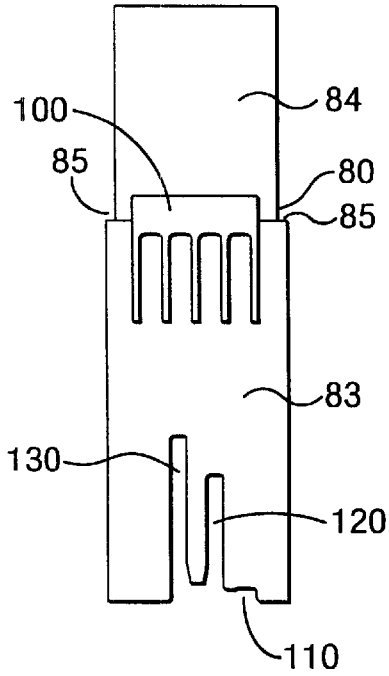
FIG. 6 is an elevational view of the outer sleeve of the pour spout shown in FIGS. 1–3.
Figure 7:
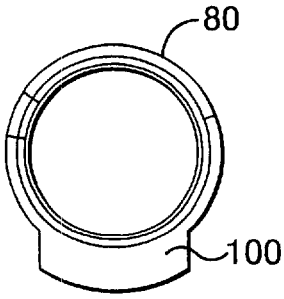
FIG. 7 is a top plan view of the outer sleeve shown in FIG. 6.

As shown in FIG. 6, the outer sleeve 80 is comprised of a first hollow tube portion 83 and a second hollow tube portion 84. The first hollow tube portion 83 has a larger diameter than the second hollow tube portion 84, thereby creating an inner annular step 85 around the outer sleeve 80. The shoulder 100 extends from one end of the first hollow tube portion 83 of the outer sleeve 80. The opposite end of the first hollow tube portion 83 of the outer sleeve 80 includes the slots 110,120,130. As shown in FIG.1, when the outer sleeve 80 is placed over the inner sleeve 30 and biasing member 90, the biasing member 90 is confined between, and bears against, the step 150 in the base 20 and the inner annular step 85 of the outer sleeve 80. As mentioned above, the biasing member 90 keeps the pour spout 10 in a normally closed position with the second hollow tube portion 84 of the outer sleeve 80 forming a seal with the end cap 70 of the conduit member 40. A top plan view of the outer sleeve 80 is shown in FIG. 7.

Figure 8:
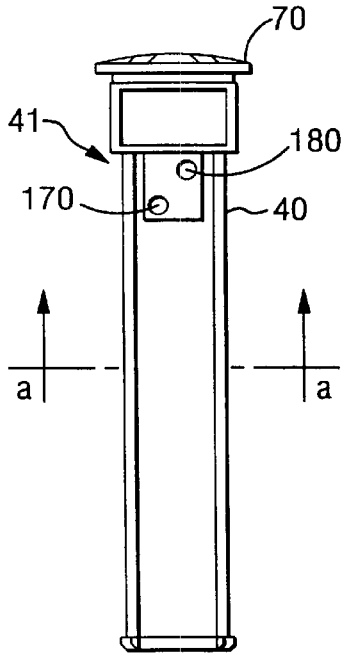
FIG. 8 is an elevational view of the conduit member shown in FIGS. 1–4.
Figure 9:
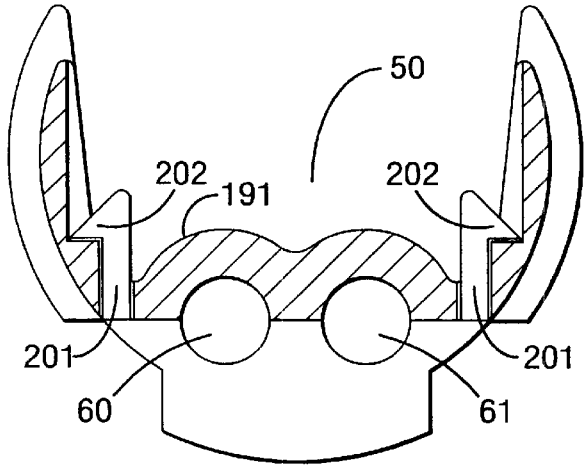
FIG. 9 is a cross-sectional view of the two-piece fluid and air tube taken along line a—a in FIG. 8.
Figure 10:
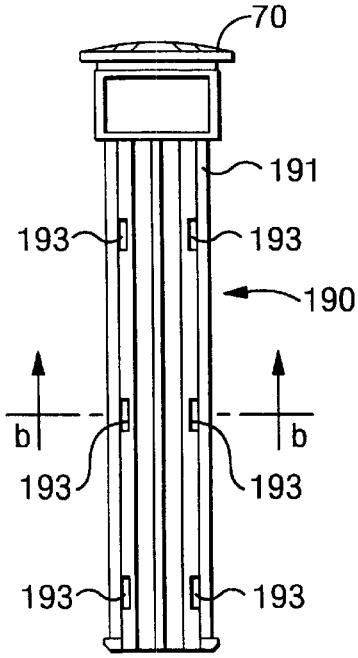
FIG. 10 is an elevational view of the back channel of the two-piece fluid and air tube shown in FIG. 9.
Figure 11:
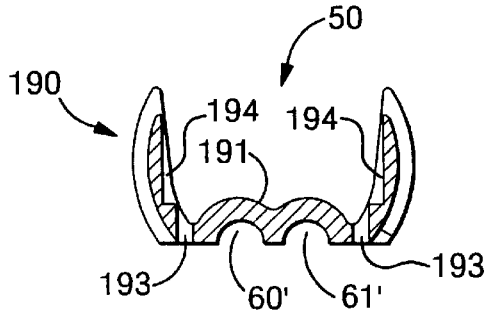
FIG. 11 is an enlarged cross-sectional view of the back channel of the two-piece fluid and air tube taken along line b—b in FIG. 10.
Figure 12:
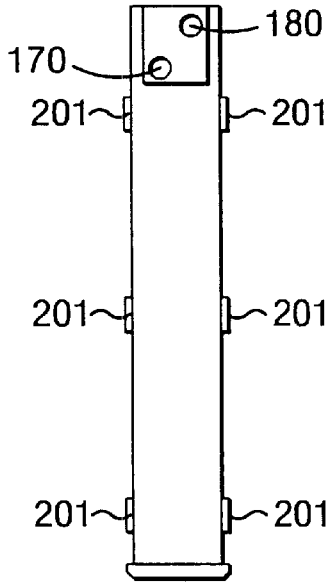
FIG. 12 is an elevational view of the air tube cover of the two-piece fluid and air tube shown in shown in FIGS. 8 and 9.
Figure 13:
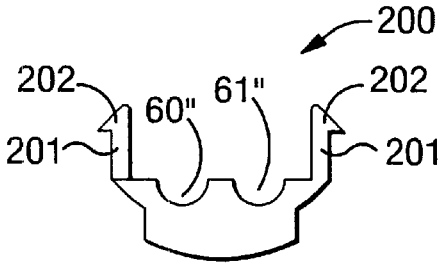
FIG. 13 is an enlarged top plan view of the air tube cover shown in FIG. 12.

In the preferred embodiment shown in FIGS. 8 and 9, the conduit member 40 includes the first and the second air tubes 60, 61, the fluid tube 50 and the end cap 70. In this particular embodiment, the air tubes 60,61 form discrete channels that are separate from the fluid tube 50. Alternatively, a single air tube can be utilized. A tip portion 41 of the conduit member 40 is exposed when the outer sleeve 80 is slid to either the first (See FIG. 2B) or the second (See FIG. 2C) open position. Referring to FIG. 1, in the tip portion 41 of the conduit member 40, the fluid tube 50 diffuses to form a fluid discharge opening 51 adjacent the end cap 70. As shown in FIGS. 8 and 9, a first air vent aperture 170 is in the tip portion 41 of the conduit member 40 and communicates with the first air tube 60. The first air vent aperture 170 is transverse to the first air tube 60 and has the same diameter as the first air tube 60. A second air vent aperture 180 is also located in the tip portion 41 of the conduit member 40 and communicates with the second air tube 61. The second air vent aperture 180 is transverse to the second air tube 61 and has the same diameter as the second air tube 61.

When the outer sleeve 80 is slid to the first open position (See FIGS. 2B and 3A), the end cap 70 and the second hollow tube portion 84 of the outer sleeve 80 no longer form a seal preventing fluid from flowing through the pour spout 10. Instead, the second air vent aperture 180 and the fluid discharge opening 51 of the conduit member 40 are exposed to the ambient atmosphere (i.e., within the vessel). Air flows from the air vent aperture 180 through the second air tube 61 allowing fluid to flow from the container through the fluid tube 50 and out the fluid discharge opening 51 as a result of a pressure differential between the atmosphere and the pressure developed in the container. This venting means also allows for an even air to fluid volume displacement resulting in an even rate of fluid flow.

When the outer sleeve 80 is slid to the second open position (See FIGS. 2C and 3B), the first and second air vent apertures 170, 180 and the fluid discharge opening 51 are exposed to the ambient atmosphere. Air flows from air vent apertures 170, 180 through air tubes 60, 61 allowing fluid to flow from the container through the fluid tube 50 and out the fluid discharge opening 51. Because the pressure differential is greater when both air vent apertures are exposed, the fluid flow rate in the second open position of the pour spout 10 is greater than the fluid flow rate in the first open position of the pour spout 10.

In a preferred embodiment illustrated in FIGS. 10–13, the conduit member 40 is constructed of two separate pieces for ease of manufacture: a fluid and air tube back channel 190 and an air tube cover 200. Back channel 190 includes the fluid tube 50, fluid discharge opening 51, end cap 70. A divider wall 191 runs from the end cap 70 to the opposite end of the back channel 190. The divider wall 191 separates the fluid tube 50 from the air tubes 60, 61. However, in the preferred embodiment, a portion of the diameter of air tubes 60, 61 are formed in the divider wall 191. The portions of the air tubes 60, 61 formed in the divider wall 191 are designated 60', 61' in FIGS. 10–11. In addition, the back channel 191 has a plurality of slots 193 and recessed grooves 194 for receiving tabs 201 and catches 202 from the air tube cover 200. The remaining portions of the air tubes 60, 61 are formed in the air tube cover 200 and are designated 60", 61" in FIG. 13. The air tube cover 200 includes the air vent apertures 170, 180. The air vent apertures 170, 180 are transverse to and intersect the semi-formed air tubes 60", 61". When assembled, the tabs 201 and catches 201 are inserted in the slots and snap fitted into the recessed grooves 194. FIG. 9 illustrates the assembled two-piece conduit member 40.

Figure 14:
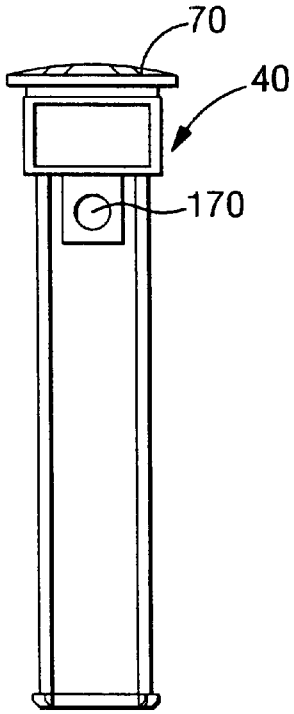
FIG. 14 is an elevational view of a second embodiment of the conduit member.
Figure 16:
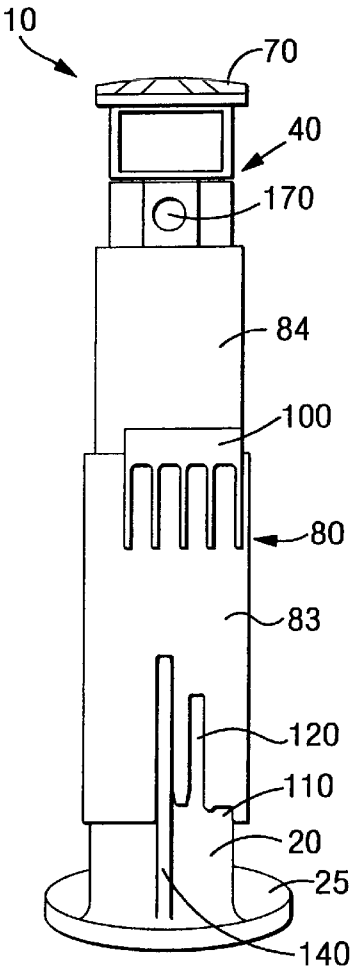
FIG. 16 is an elevational view of a pour spout having the conduit member shown in FIG. 14 in a second open position.
Figure 15:
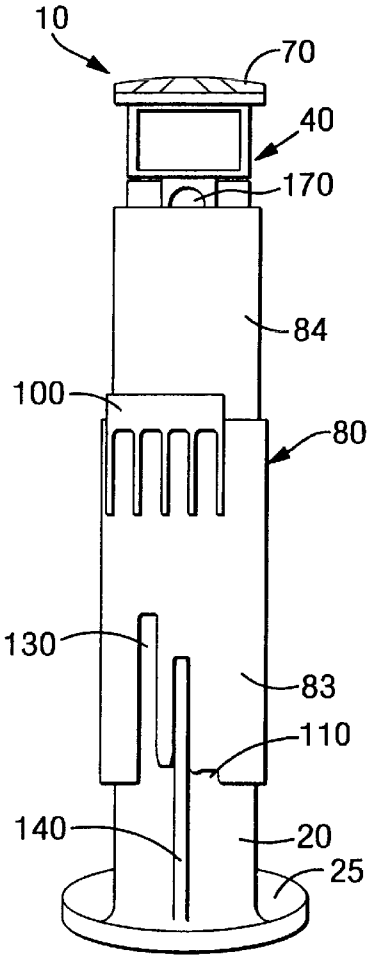
FIG. 15 is an elevational view of a pour spout having the conduit member shown in FIG. 14 in a first open position.

Another embodiment of the present invention is shown in FIGS. 14–16. In this embodiment, there is only a single air tube 60 in the conduit member 40. As a result there is also only a single air vent aperture 170. The diameter of the air vent aperture 170 is the same as the air tube 60. With reference specifically to FIG. 15, when the outer sleeve 80 is slid into the first open position, a first portion of the air vent aperture 170 is exposed. As shown in FIG. 16, the entire air vent aperture 170 is exposed in the second open position. Alternatively, a greater portion of the air vent aperture 170 may be exposed in the second position compared to that of the first position. In all other respects, the embodiment illustrated in FIGS. 14–16 is the same as the embodiment illustrated in FIGS. 1–13 and discussed above.

Figure 17:
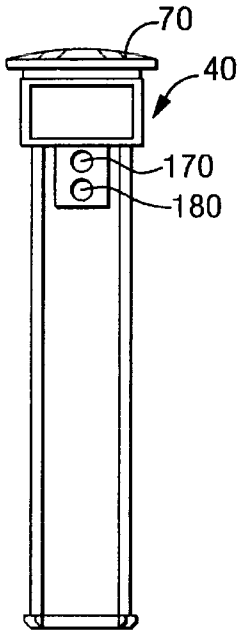
FIG. 17 is an elevational view of a third embodiment of the conduit member.

In yet another embodiment illustrated in FIG. 17, there is a single air tube 60 in the conduit member 40. However, rather than having a single air vent aperture 170, there are first and second air vent apertures 170, 180 which communicate with the single air tube 60. The first and second air vent apertures 170, 180 are transverse to, and have the same diameter as, the air tube 60. In the first open position, only the first air vent aperture 170 is exposed. In the second open position, the first and second air vent apertures 170,180 are exposed. Alternatively, in each of the positions, only a portion of the air vent apertures 170, 180 are exposed. In all other respects, the embodiment illustrated in FIGS. 14–16 is the same as the embodiment illustrated in FIGS. 1–13 and discussed above.

It should be noted that for all of the embodiments described, when an air vent aperture is exposed in a particular indexed position of the outer sleeve 80, it may be partially covered by the outer sleeve 80. The resulting partial exposure of an air vent aperture regulates the intake of air through the associated air tube(s), thereby governing the flow rate. By changing the amount in which the air vent aperture is exposed, pour spout designs having various multiple flow rate positions can be achieved. Thus, for certain flow rates, a given air vent aperture may not be fully exposed to the ambient atmosphere.

It should also be noted that the indexed positioning of the outer sleeve can be achieved through means other than a slot and protrusion combination. For example, a series of detents can be provided on either the outer surface of the inner sleeve or the inner surface of the outer sleeve that coact with a corresponding protrusion on an opposing surface. Such an arrangement would be within the skill of one of ordinary skill in the mechanical arts.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A pour spout for transferring fluid from a container to a vessel, the pour spout comprising:

a base having an inner sleeve extending outwardly therefrom;

a conduit member located in the inner sleeve comprising a fluid tube, an air tube and an end cap; and an outer sleeve slidingly engaging the inner sleeve, wherein the outer sleeve is adapted to be slid to a first closed position wherein the outer sleeve is in contact with the end cap preventing fluid flow from the pour spout, and wherein the outer sleeve is adapted to be slid to a first open position permitting fluid to flow at a first flow rate through the fluid tube and out of the pour spout, and wherein the outer sleeve is adapted to be slid to a second open position permitting fluid to flow at a second flow rate through the fluid tube at a second flow rate and out of the pour spout, the outer sleeve capable of being placed in a locked position that prevents the outer sleeve from sliding with respect to the inner sleeve and maintains the outer sleeve in the first closed position.

2. The pour spout of claim 1, wherein the second flow rate is greater than the first flow rate.

3. The pour spout of claim 1, wherein the outer sleeve has a shoulder extending outwardly therefrom that is capable of bearing against a receptacle of the vessel to facilitate movement of the outer sleeve when the pour spout is pushed against the receptacle.

4. The pour spout of claim 1, wherein the outer sleeve has a slot and the base has a protrusion that cooperates with the slot to allow the outer sleeve to be slid to the first open position.

5. The pour spout of claim 1, wherein the outer sleeve has a slot and the base has a protrusion that cooperates with the slot to allow the outer sleeve to be slid to the second open position.

6. A pour spout for transferring fluid from a container to a vessel, the pour spout comprising:

a base having an inner sleeve extending outwardly therefrom;

a conduit member located in the inner sleeve comprising a fluid tube, an air tube and an end cap; and an outer sleeve slidingly engaging the inner sleeve, wherein the outer sleeve is adapted to be slid to a first closed position wherein the outer sleeve is in contact with the end cap preventing fluid flow from the pour spout, and wherein the outer sleeve is adapted to be slid to a first open position permitting fluid to flow at a first flow rate through the fluid tube and out of the pour spout, and wherein the outer sleeve is adapted to be slid to a second open position permitting fluid to flow at a second flow rate through the fluid tube at a second flow rate and out of the pour spout wherein the air tube has a first and a second air vent aperture at one end thereof.

7. The pour spout of claim 6, wherein the outer sleeve covers the first and second air vent apertures in the air tube when the outer sleeve is in the closed position.

8. The pour spout of claim 6, wherein the outer sleeve covers the first air vent aperture in the air tube but not the second air vent aperture in the air tube when the outer sleeve is in the first open position.

9. The pour spout of claim 6, wherein the outer sleeve does not cover either the first or second air vent apertures in the air tube when the outer sleeve is in the second open position.

10. The pour spout of claim 6, wherein the air tube has a cross-sectional area and the first and second air vent apertures have a cross-sectional area, the cross-sectional area of the air tube being substantially the same as the cross-sectional area of the first and second air vent apertures.

11. The pour spout of claim 1 further comprising an air vent aperture located in the conduit member and disposed transverse to and in communication with the air tube.

12. The pour spout of claim 11, wherein the air tube has a cross-sectional area and the air vent aperture has a cross-sectional area, the cross sectional area of the air vent aperture being greater than the cross-sectional area of the air tube.

13. The pour spout of claim 12, wherein the fluid tube and a first portion of the cross-sectional area of the air vent aperture is exposed when the outer sleeve is slid to the first open position, thereby permitting the fluid to flow through the pour spout at the first flow rate.

14. The pour spout of claim 12, wherein the fluid tube, the first portion and a second portion of the cross-sectional area of the air vent aperture is exposed when the outer sleeve is slid to the second open position, thereby permitting the fluid to flow through the pour spout at the second flow rate.

15. A pour spout for transferring fluid from a container to a vessel, the pour spout comprising:

a base having an inner sleeve extending outwardly therefrom;

a conduit member located in the inner sleeve comprising a fluid tube, a first air tube, a second air tube and an end cap;

an outer sleeve slidingly engaging the inner sleeve and having a closed position that precludes the transfer of fluid through the air pour spout;

a bias member urging the outer sleeve into the closed position; and the outer sleeve having a shoulder for coacting with the vessel to slide the outer sleeve from the closed position to either a first or a second open position.

16. The pour spout of claim 15, wherein the base has a protrusion and the outer sleeve has a first slot, and wherein by rotating the outer sleeve relative to the inner sleeve the protrusion may be aligned with the first slot to prevent the outer sleeve from being slid to either the first or second open position.

17. The pour spout of claim 15, wherein the base has a protrusion and the outer sleeve has a first and a second slot, and wherein:

by rotating the outer sleeve relative to the inner sleeve the protrusion may be aligned with the first slot to prevent the outer sleeve from being slid to either the first or second open position; and by rotating the outer sleeve further relative to the inner sleeve the protrusion may be aligned with the second slot allowing the pour spout to be opened to the first position when the shoulder coacts with the receiving vessel.

18. The pour spout of claim 15, wherein the base has a protrusion and the outer sleeve has a first, a second and a third slot, wherein:

by rotating the outer sleeve relative to the inner sleeve the protrusion may be aligned with the first slot to prevent the outer sleeve from being slid to either the first or second open position;

by rotating the outer sleeve further relative to the inner sleeve the protrusion may be aligned with the second slot allowing the pour spout to be opened to the first open position when the shoulder coacts with the receiving vessel; and by rotating the outer sleeve further relative to the inner sleeve the protrusion may be aligned with the second slot allowing the pour spout to be opened to the second open position when the shoulder coacts with the receiving vessel.

19. The pour spout of claim 15, further including a first air vent aperture positioned in the conduit member transverse to the first air tube, wherein when the outer sleeve is slid to the first open position, the air vent aperture is exposed allowing air to travel through the air tube and fluid to travel at a first flow rate through the fluid tube and out the spout.

20. The pour spout of claim 15, further including a first air vent aperture positioned in the conduit member transverse to the first air tube and a second air vent aperture positioned in the conduit member transverse to the second air tube, wherein when the outer sleeve is slid to the second open position, the first and second air vent apertures are exposed allowing air to travel through the first and second air tubes and fluid to travel at a second flow rate through the fluid tube and out the spout.

21. The pour spout of claim 15, further including a first air vent aperture positioned in the conduit member transverse to the first air tube and a second air vent aperture positioned in the conduit member transverse to the second air tube, wherein:

when the outer sleeve is slid to the first open position, the first air vent aperture is exposed allowing air to travel through the first air tube and fluid to travel at a first flow rate through the fluid tube and out the spout; and when the outer sleeve is slid to the second open position, the first and second air vent apertures are exposed allowing air to travel through the first and second air tubes and fluid to travel at a second flow rate through the fluid tube and out the spout.

22. The pour spout of claim 15, wherein the first flow rate is less than the second flow rate.

23. A pour spout for transferring fluid from a container to a vessel, the pour spout removably connectable to the container and including an inner sleeve, a conduit member disposed within the inner sleeve and forming a fluid tube and an air tube therein, and an outer sleeve disposed around the inner sleeve and moveable with respect to the inner sleeve, the outer sleeve being moveable to a closed position wherein the outer sleeve cooperates with the conduit member to prevent fluid flow from the pour spout, a first flow rate position wherein the air tube is in communication with ambient air to allow air to flow therethrough at a first air flow rate to facilitate flow of the fluid through the fluid tube at a first fluid flow rate, and a second flow rate position wherein the air tube is in communication with ambient air to allow air to flow therethrough at a second air flow rate to facilitate flow of the fluid through the fluid tube at a second flow rate, the outer sleeve adapted such that it stops and is maintained in its respective flow rate position when a force is continuously applied to the outer sleeve sufficient to move the outer sleeve with respect to the inner sleeve.

24. The pour spout of claim 23, wherein the outer sleeve is further moveable to a locked position that maintains the outer sleeve in the closed position until removed from the locked position.

25. A pour spout for transferring fluid from a container to a vessel, the pour spout removably connectable to the container and including an inner sleeve, a conduit member disposed within the inner sleeve and forming a fluid tube and two air tubes therein, and an outer sleeve disposed around the inner sleeve portion and moveable with respect to the inner sleeve portion, the outer sleeve being moveable to a closed position wherein the outer sleeve cooperates with the conduit member to prevent fluid flow from the pour spout, a first flow rate position wherein one of the air tubes is in communication with ambient air to allow air to flow into the container at a first air flow rate to facilitate flow of the fluid through the fluid tube at a first fluid flow rate, and a second flow rate position wherein both air tubes are in communication with ambient air to allow air to flow into the container at a second air flow rate to facilitate flow of the fluid through the fluid tube at a second flow rate.

26. The pour spout of claim 25, wherein the outer sleeve is further moveable to a locked position that maintains the outer sleeve in the closed position until removed from the locked position.

27. A pour spout for transferring fluid from a container to a vessel, the pour spout comprising:

a base having an inner sleeve extending outwardly therefrom;

a conduit member located in the inner sleeve and including a fluid passage, an air passage and an end cap; and an outer sleeve slidingly engaging the inner sleeve, wherein the outer sleeve is capable of being slid to a closed position wherein the outer sleeve is in contact with the end cap preventing fluid flow from the fluid passage, and wherein the outer sleeve is capable of being slid to a first open position permitting fluid to flow at a first flow rate through the fluid passage, and wherein the outer sleeve is capable of being slid to a second open position permitting fluid to flow at a second flow rate through the fluid passage at a second flow rate, the outer sleeve adapted such that it is prevented from sliding beyond its respective position when it is in either open postion.

28. A pour spout for transferring fluid from a container to a vessel, the pour spout removably connectable to the container and comprising an inner sleeve, a conduit member disposed within the inner sleeve and forming a fluid passage and an air passage therein, and an outer sleeve disposed around the inner sleeve and moveable with respect to the inner sleeve, the outer sleeve being moveable to:

a closed position wherein the outer sleeve cooperates with the conduit member to prevent fluid flow from the pour spout, a first flow rate position wherein the air passage is in communication with ambient air to allow air to flow therethrough at a first air flow rate to facilitate flow of the fluid through the fluid passage at a first fluid flow rate, and a second flow rate position wherein the air passage is in communication with ambient air to allow air to flow therethrough at a second air flow rate to facilitate flow of the fluid through the fluid passage at a second flow rate, the outer sleeve adapted to be maintained in its respective flow rate position when a force is continuously applied to the outer sleeve sufficient to move the outer sleeve with respect to the inner sleeve.

* * * * *